US008684795B2

(12) United States Patent
Shibata

(10) Patent No.: US 8,684,795 B2
(45) Date of Patent: Apr. 1, 2014

(54) EYEGLASS LENS PROCESSING APPARATUS

(75) Inventor: Ryoji Shibata, Aichi (JP)

(73) Assignee: Nidek Co., Ltd., Aichi (JP)

( * ) Notice: Subject to any disclaimer, the term of this patent is extended or adjusted under 35 U.S.C. 154(b) by 662 days.

(21) Appl. No.: 12/831,809

(22) Filed: Jul. 7, 2010

(65) Prior Publication Data

US 2011/0009036 A1 Jan. 13, 2011

(30) Foreign Application Priority Data

Jul. 8, 2009 (JP) ..... 2009-162154

(51) Int. Cl.
*B24B 9/14* (2006.01)

(52) U.S. Cl.
USPC ..... 451/43; 451/41; 451/42; 451/44

(58) Field of Classification Search
USPC ..... 451/43, 5, 41, 42, 44, 8, 9, 10, 11
See application file for complete search history.

(56) References Cited

U.S. PATENT DOCUMENTS 3,353,303 A * 11/1967 Stern ..... 451/43
4,176,498 A * 12/1979 Vulich et al. ..... 451/240
4,179,851 A * 12/1979 Neisler et al. ..... 451/240
4,233,784 A * 11/1980 Loreto ..... 451/22
4,286,415 A * 9/1981 Loreto ..... 451/43
4,612,736 A * 9/1986 Massard et al. ..... 451/5
4,720,942 A * 1/1988 Miller ..... 451/547
4,829,715 A * 5/1989 Langlois et al. ..... 451/9
5,056,270 A * 10/1991 Curcher ..... 451/43
5,321,915 A * 6/1994 Lecerf et al. ..... 451/6
5,371,974 A * 12/1994 Lecerf et al. ..... 451/5
5,630,746 A * 5/1997 Gottschald et al. ..... 451/5
5,643,052 A * 7/1997 Delattre et al. ..... 451/21
5,775,973 A * 7/1998 Watanabe ..... 451/5
6,089,957 A * 7/2000 Shibata ..... 451/41
6,099,383 A * 8/2000 Mizuno et al. ..... 451/5
6,328,630 B1 * 12/2001 Jinbo et al. ..... 451/11
6,336,057 B1 * 1/2002 Obayashi ..... 700/164

(Continued)

FOREIGN PATENT DOCUMENTS

CN 101234514 A 8/2008
EP 1510290 A1 3/2005

(Continued)

OTHER PUBLICATIONS

Office Action dated Dec. 4, 2013 issued by the State Intellectual Property Office of the People's Republic of China in counterpart Chinese Patent Application No. 201010224937.9.

*Primary Examiner* — Joseph J Hail
*Assistant Examiner* — Joel Crandall
(74) *Attorney, Agent, or Firm* — Sughrue Mion, PLLC

(57) ABSTRACT

An eyeglass lens processing apparatus is provided with: a lens chuck shaft that holds an eyeglass lens; and a beveling tool for forming a bevel on the periphery of the lens. The beveling tool includes a first processing part for forming a rear bevel on the lens rear side; and a second processing part for forming a bevel foot coupled to the rear bevel. In the second processing part, the distance from a line parallel to the lens chuck shafts and passing through a point of border with the first processing part gradually increases from the point of border as the starting point to the endpoint of the second processing surface and the increase rate of the distance gradually increases at least in two steps toward the endpoint.

5 Claims, 8 Drawing Sheets

(56) References Cited

U.S. PATENT DOCUMENTS

| | | | | |
|---|---|---|---|---|
| 6,547,642 | B2 * | 4/2003 | Hatano | 451/11 |
| 6,790,124 | B2 | 9/2004 | Shibata | |
| 7,540,798 | B2 * | 6/2009 | Shibata | 451/5 |
| 7,713,108 | B2 * | 5/2010 | Takeichi | 451/43 |
| 7,731,565 | B2 * | 6/2010 | Shibata et al. | 451/5 |
| 7,803,035 | B2 * | 9/2010 | Nauche et al. | 451/5 |
| 8,007,344 | B2 * | 8/2011 | Obayashi et al. | 451/5 |
| 8,038,507 | B2 * | 10/2011 | Obayashi | 451/5 |
| 8,083,572 | B2 * | 12/2011 | Nauche | 451/43 |
| 8,235,770 | B2 * | 8/2012 | Obayashi | 451/43 |
| 8,241,534 | B2 * | 8/2012 | Akiyama | 264/1.1 |
| 2002/0022436 | A1 | 2/2002 | Mizuno et al. | |
| 2003/0224701 | A1 * | 12/2003 | Guillermin et al. | 451/5 |
| 2006/0217036 | A1 * | 9/2006 | Meunier et al. | 451/5 |
| 2007/0298686 | A1 * | 12/2007 | Shibata | 451/5 |
| 2008/0186446 | A1 | 8/2008 | Takeichi | |
| 2009/0011687 | A1 * | 1/2009 | Shibata et al. | 451/240 |

FOREIGN PATENT DOCUMENTS

| | | | |
|---|---|---|---|
| JP | 2001-315045 | A | 11/2001 |
| JP | 2003-145328 | A | 5/2003 |
| JP | 2005-074560 | A | 3/2005 |
| JP | 2007-319984 | A | 12/2007 |
| JP | 2008-254078 | A | 10/2008 |

* cited by examiner

EYEGLASS LENS PROCESSING APPARATUS

BACKGROUND OF THE INVENTION

The present invention relates to an eyeglass lens processing apparatus for beveling a periphery of an eyeglass lens to be fitted in an eyeglass frame.

Eyeglass lens processing apparatuses are provided with a beveling tool such as a grindstone having a V groove (bevel groove) for forming a bevel on a periphery of a rough-edged eyeglass lens. Moreover, in recent years, more and more eyeglass frames have a sharp curve, and high-curve lenses whose the curves of the refractive surfaces are sharp are used. When the bevel is formed on the high-curve lens, the use of the large-diameter beveling grindstone having the V groove causes a so-called bevel thinning (a phenomenon in which the height or the width of the bevel is small). As solutions thereto, the following are proposed: an apparatus having a beveling grindstone that separately forms a front bevel on the lens front side and a rear bevel on the lens rear side (Japanese Unexamined Patent Application Publication No. 2008-254078 [corresponding to US 2009011687]); and an apparatus having a small-diameter beveling grindstone (Japanese Unexamined Patent Application Publication No. 2005-74560 [corresponding to EP 1510290]).

In related beveling tools such as beveling grindstones, as shown in FIG. 1, a processing surface Vrk for forming a rear bevel foot (rear side lens edge coupled to the rear bevel) LVrk coupled to the rear bevel LVr on the lens rear side has a constant inclination angle with respect to the x-axis direction of a lens chuck shaft. FIG. 1 is a structural view of grindstones shown in Japanese Unexamined Patent Application Publication No. 2008.254078, and illustrates an example of beveling grindstones that separately form a front bevel LVf and a rear bevel LVr of a high-curve lens. A processing surface Vr for forming the rear bevel LVr and the processing surface Vrk for forming the rear bevel foot LVrk are integrally formed on a rear beveling grindstone GVr. The inclination angle $\alpha k$ of the processing surface Vrk with respect to the x-axis direction is constant from the point Ps of border with the processing surface Vr to the endpoint Pe. That is, the increase rate of the distance to the processing surface Vrk from a line Xs parallel to the x-axis direction and passing through the border point Ps is constant. For example, the inclination angle $\alpha k$ is 15 degrees, and is set as an angle necessary for avoiding the interference between the bevel foot and the rim of the eyeglass frame when the lens having the bevel formed thereon is held by the rim. Moreover, importance is placed on the appearance of thin-edge lenses. However, when a thick-edge lens is processed with the beveling grindstone GVr thereafter, the edge largely protrudes rearward and looks thick. In particular, in the case of high-curve lenses, the edge of the rear bevel foot LVrk is rather sharp, and the sharp edge readily touches the user's cheek.

An example of a method of thinning the edge on the lens rear side is to additionally perform chamfering. However, a large chamfer for rendering the edge look thin requires a skill and time when it is made by hand, and an inexperienced worker cannot make a good-looking chamfer. Although there is a method in which a chamfering mechanism having a chamfering tool is provided in the apparatus, not only an extra time is required for the chamfering process but also the apparatus is complicated and the price of the apparatus is high. Moreover, for high-curve lenses, the accuracy of estimation of the angle part position of after the bevel foot formation is low, so that by a method based on the estimation of the angle part position, chamfering as planned is difficult to perform.

SUMMARY OF THE INVENTION

The present invention is made in view of the above-mentioned problem of the conventional art, and an object thereof is to provide an eyeglass lens processing apparatus with which the edge of the bevel foot coupled to the rear bevel can be thinned and the sharpness of the edge can be reduced with a simple structure.

To solve the above-mentioned problem, the present invention is provided with:

(1) An eyeglass lens processing apparatus comprising:

a lens rotating unit which includes a lens chuck shaft for holding an eyeglass lens and a motor for rotating the lens chuck shaft; and a tool rotating unit which includes a beveling tool for forming a bevel on a periphery of the lens, a spindle to which the beveling tool is attached and which is disposed parallel to the lens chuck shaft or disposed to be inclined with respect to the lens chuck shaft at a predetermined angle, and a motor for rotating the spindle, wherein the beveling tool includes a first processing part for forming a rear bevel at a rear side of the lens and a second processing part for forming a bevel foot coupled to the rear bevel, and wherein in the second processing part, a distance from a line parallel to the lens chuck shaft and passing through a point of a border with the first processing part gradually increases from the border point as the starting point to an endpoint of the second processing surface and an increase rate of the distance gradually increases at least in two steps from the border point to the endpoint.

(2) The eyeglass lens processing apparatus according to (1), wherein in a case in which the increase rate of the distance is expressed by an inclination angle with respect to the line parallel to the lens chuck shaft, the inclination angle in the vicinity of the border point is not less than 10 degrees and the inclination angle in the vicinity of the endpoint is not more than 60 degrees.

(3) The eyeglass lens processing apparatus according to (1), wherein the second processing part at least partially includes a curved shape in which the increase rate of the distance continuously gradually increases toward the endpoint.

(4) The eyeglass lens processing apparatus according to (1), wherein the second processing part includes a curved shape in which the increase rate of the distance continuously gradually increases from the border point to the end point.

(5) The eyeglass lens processing apparatus according to (1), wherein the second processing part includes a straight line shape where the increase rate of the distance is constant from the border point to the midpoint located between the border point and the end point, and a curved shape where the increase rate of the distance continuously gradually increases from the midpoint to the end point.

According to the present invention, the edge of the bevel food coupled to the rear bevel can be thinned and the sharpness of the edge end can be reduced with a simple structure. In addition, in the case of thin-edge lenses, the width of the bevel foot when viewed from the lens front or rear side can be made inconspicuous.

BRIEF DESCRIPTION OF THE INVENTION

DESCRIPTION OF EXEMPLARY EMBODIMENTS

Figure 2:
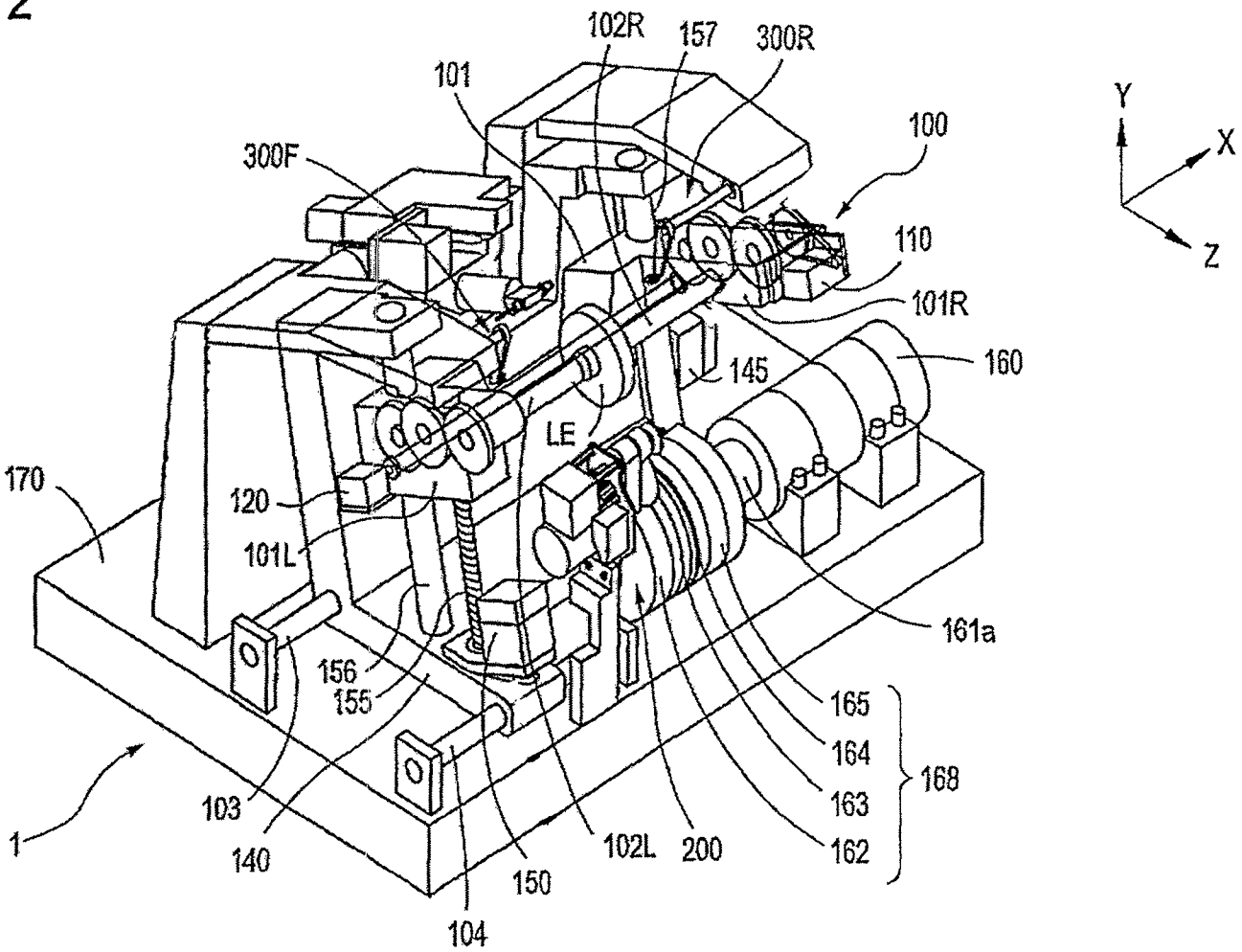
FIG. 2 is an explanatory view of a processing portion of an eyeglass lens processing apparatus.

Hereinafter, an exemplary embodiment according to the present invention will be described with reference to the drawings. FIG. 2 is a schematic structural view of a processing portion of an eyeglass lens processing apparatus according to the present invention.

A carriage unit 100 is mounted on a base 170 of a processing apparatus body 1. A periphery of a processed lens LE held between lens chuck shafts (lens rotation shafts) 102L and 102R of a carriage 101 is processed while being pressed against a grindstone group 168 as a lens processing tool attached coaxially with a spindle (grindstone rotation axis) 161*a*. The grindstone group 168 includes: a rough grindstone 162 for glass; a bevel finishing grindstone 163 as a beveling tool for high-curve lenses; a bevel finishing grindstone 164 as a beveling tool for low-curve lenses; and a rough grindstone 165 for plastic. On the bevel finishing grindstone 164, a V groove (bevel groove) for low-curve lens bevel formation and a processing surface, for the bevel foot on the lens rear side and flat-processing, coupled to the V groove are integrally formed. The spindle 161*a* is disposed parallel to the lens chuck shafts 102L and 102R, and rotated by a motor 160.

The lens chuck shaft 102L and the lens chuck shaft 102R are coaxially and rotatably held by a left arm 101L and a right arm 101R of the carriage 101, respectively. The lens chuck shaft 1028 is moved toward the lens chuck shaft 102L side by a motor 110 attached to the right arm 101R. The lens chuck shafts 102R and 102L are rotated in synchronism with each other through a rotation transmission mechanism such as a gear by a motor 120 attached to the left arm 101L. These members constitute lens rotating unit.

The carriage 101 is mounted on a support base 140 movable along shafts 103 and 104 extending in the x-axis direction, and is linearly moved in an x-axis direction (the axial direction of the lens chuck shafts) by rotation of a motor 145. These members constitute an x-axis direction movement unit. Shafts 156 and 157 extending in a y-axis direction (the direction in which the axis-to-axis distance between the lens chuck shafts 102L and 102R and the grindstone spindle 161*a* is varied) are fixed to the support base 140. The carriage 101 is mounted on the support base 140 so as to be movable in the y-axis direction along the shafts 156 and 157, A motor 160 for y-axis movement is fixed to the support base 140. The rotation of the motor 150 is transmitted to a ball screw 155 extending in the y-axis direction, and the carriage 101 is moved in the y-axis direction by the rotation of the ball screw 155. These members constitute y-axis direction movement unit.

In FIG. 2, lens edge position measurement units (lens edge position detection units) 300F and 300R are provided above the carriage 101. The lens edge position measurement unit 300F has a tracing stylus that is in contact with the front surface of the lens LE, and the lens edge position measurement unit 300R has a tracing stylus that abuts on the rear surface of the lens LE. By moving the carriage 101 in the y-axis direction based on the target lens shape data and rotating the lens LE with these tracing styluses being in contact with the front and rear surfaces of the lens LE, respectively, the edge positions on the lens front surface and the lens rear surface for lens periphery processing are simultaneously measured. As the structure of the lens edge position measurement units 300F and 300R, basically, the one described in Japanese Unexamined Patent Application Publication No. 2003.145328 (U.S. Pat. No. 6,790,124) may be used.

In FIG. 2, a chamfering mechanism 200 having a chamfering grindstone is disposed on the front side of the apparatus body 1. As the mechanism 200, a known structure described in Japanese Unexamined Patent Application Publication No. 2001-315045 (US 2002022436) is used.

Figure 3:
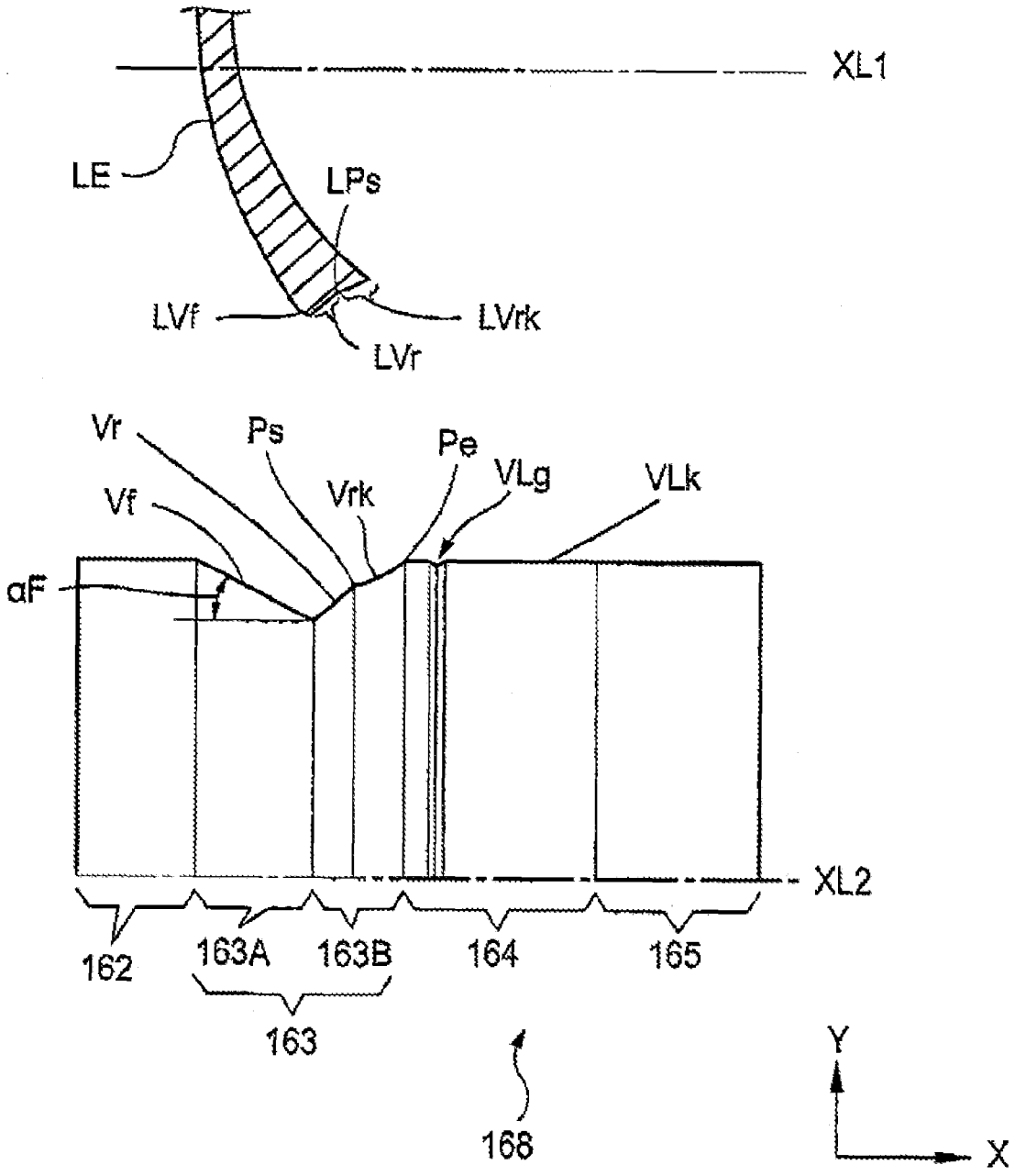
FIG. 3 is a structural view of grindstones of the eyeglass lens processing apparatus.

Next, the structure of the beveling grindstones 163 and 164 will be described. FIG. 3 is a structural view of the grindstone group 168, and illustrates approximately a half of each grindstone with respect to an axis line XL2 of the center of rotation of the spindle 161*a*. In the present embodiment, the axis line XL2 of the spindle 161*a* is disposed parallel to an axis line XL1 of the lens chuck shafts 102L and 102R.

The bevel finishing grindstone 164 for low-curve lenses includes: a V groove VLg for simultaneously forming a bevel LVr on the lens front side (hereinafter, referred to as front bevel) and a bevel LVr on the lens rear side (hereinafter, referred to as rear bevel); and a flat-processing surface VLk for forming the rear bevel foot LVrk coupled to the rear bevel (the rear side lens edge coupled to the rear bevel) and a flat surface for flat-processing. The depth of the V groove VLg is approximately 1 mm. The inclination angles (inclination angles with respect to the x-axis direction) of the processing surfaces of the V groove VLg for forming the front bevel LVf and the rear bevel LVr are both 35 degrees.

The bevel finishing grindstone 163 for high-curve lenses include: a front beveling grindstone 163A having a processing surface Vf for forming the front bevel LVf; and a rear beveling grindstone 163B having a processing surface Vr for forming the rear bevel LVr and a processing surface Vrk for forming the rear bevel foot LVrk. The inclination angle of the processing surface Vf with respect to the x-axis direction is 30 degrees which is gentler than the angle of the front beveling inclined surface of the finishing grindstone 164. While the front beveling grindstone 168A and the rear beveling grindstone 163B are integrally formed, they may be separately provided. The outermost diameters of the front beveling grindstone 163A and the rear beveling grindstone 163B are the same as the outermost diameter of the rough grindstone 165. Thereby, the minimum processable lens diameter can be minimized by effectively using the processing surfaces of the rear beveling grindstone 163B.

Figure 4:
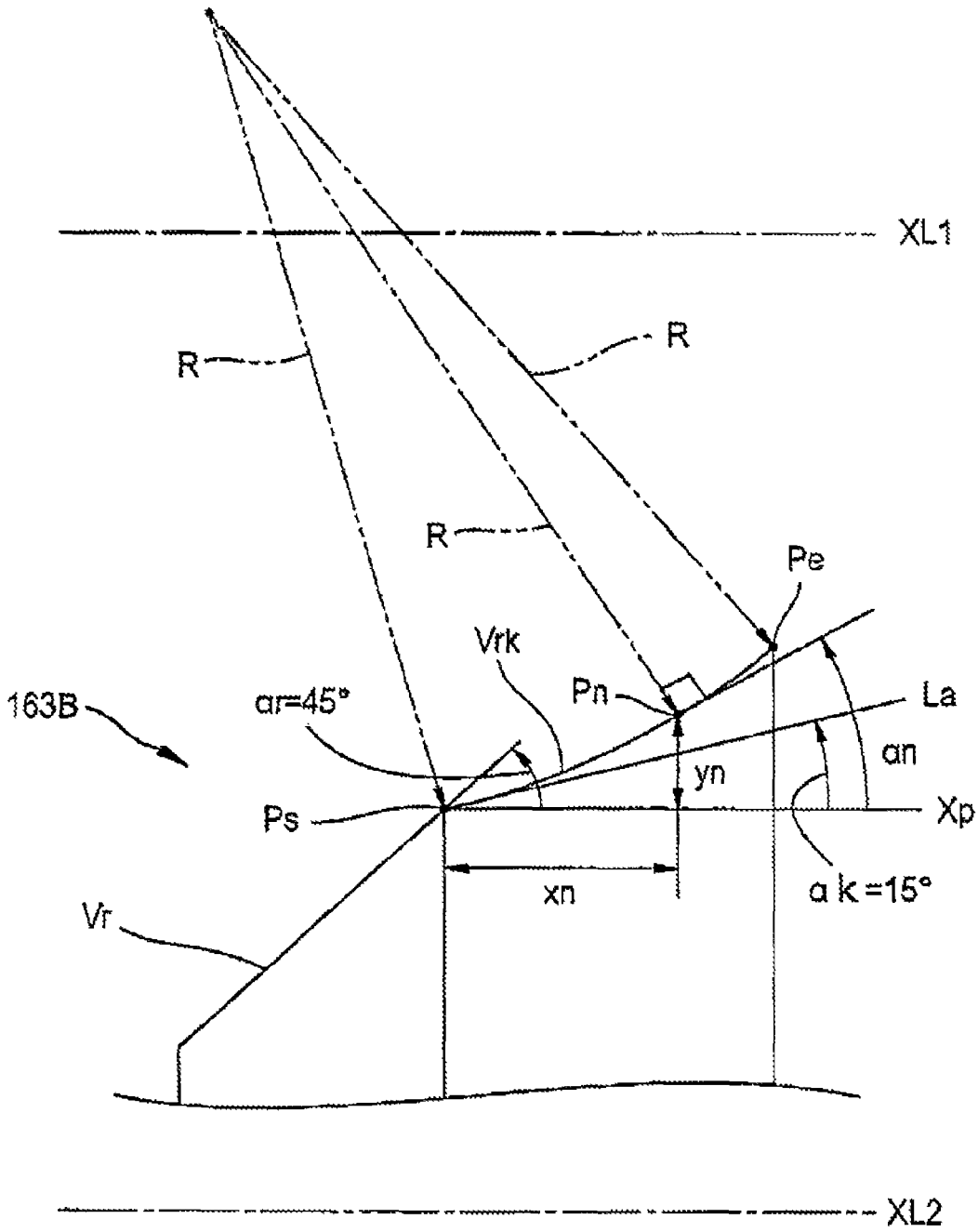
FIG. 4 is an enlarged view for explaining processing surfaces of a rear beveling grindstone.

FIG. 4 is an enlarged view for explaining a first example of the processing surface Vr (first processing part) and the processing surface Vrk (second processing part) of the rear beveling grindstone 163B. The shapes of the processing surface Vr and the processing surface Vrk of FIG. 4 are illustrated as a cross-sectional view taken along a plane (x-y plane) including the axis line XL1 of the chuck axes 102L and 102R and the axis line XL2 of the spindle 161*a*.

In FIG. 4, the point of border between the processing surface Vr and the processing surface Vrk is represented as the starting point Ps, and the endpoint of the processing surface Vrk in the direction toward the lens rear side (rightward in FIG. 4) is represented as Pe. A line extending in the x-axis direction through the point Ps (line parallel to the axis line XL2 of the lens chuck shafts) is represented as Xp. The inclination angle αr, with respect to the line Xp, of the processing surface Vr for rear bevel formation is larger than that of the V groove VLg of the grindstone 164 for low-curve lenses, and is set to 45 degrees. For high-curve lenses, by also steepening the inclination of the rear bevel, the bevels formed on a lens can be easily fitted on the rim of the eyeglass frame.

The inclination angle, with respect to the direction of the line Xp, of the processing surface Vrk for rear bevel formation has, a value (path) that gradually increases at least in two steps from the starting point Ps to the endpoint Pe unlike the conventional constant one (straight line). When the shape of the processing surface Vrk is considered as the distance from the line Xp, it is expressed as follows: When a point Pn that moves every minute distance on the path between the starting point Ps and the endpoint Pe is considered, assuming that the distance from the point Pn to the line Xp (the length of the perpendicular line dropped from the point Pn to the line Xp) is yn, the processing surface Vrk has a shape in which the distance yn gradually increases from the starting point Ps toward the endpoint Pe and the increase rate of the distance yn gradually increases at least in two steps toward the endpoint Pe. In the first example of FIG. 4, the processing surface Vrk has a curved shape in which the increase rate of the distance yn continuously gradually increases from the starting point Ps toward the endpoint Pe.

When the shape of the processing surface Vrk of FIG. 4 is expressed as the inclination angle with respect to the line Xp, the processing surface Vrk is formed so that the inclination angle αn between the point Pn and the next point Pn moved a minute distance therefrom gradually increases as the point Pn approaches the endpoint Pe. In other words, the processing surface Vrk is formed so that the differential value at the point Pn gradually increases as the point Pn approaches the endpoint Pe.

Figure 1:
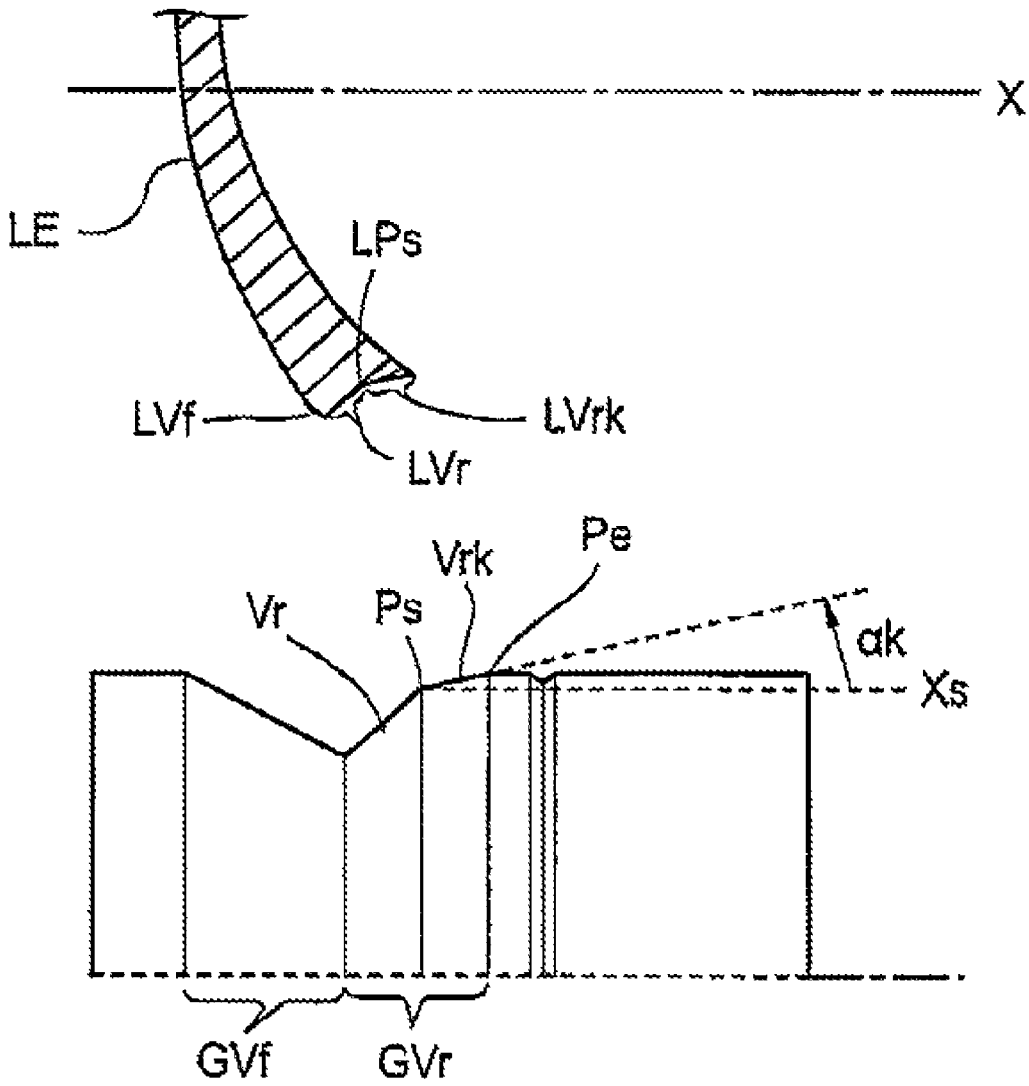
FIG. 1 is a structural view of the grindstones of the conventional apparatus.

In the first example of FIG. 4, assuming that La is a straight line passing through the point Ps at an inclination angle αk with respect to the line Xp, the curved line of the path of the processing surface Vrk is an arc having a fixed radius R and in contact with the straight line La at the point Ps. The inclination angle αk (the increase rate of the distance yn) of the straight line La is set to a value where the bevel foot LVrk does not interfere with the surface Rmr, opposed to the edge, of the rim Rm (see FIGS. 5A and 5B) when the processed lens is fitted on the rim Rm of an eyeglass frame. The inclination angle αk of the straight line La is also the inclination angle in the vicinity of the point Ps. In the case of high-curve lenses, since the rims of eyeglass frames are also curved, it is preferable that the inclination angle in the vicinity of the point Ps be not less than 10 degrees. When the inclination angle is not more than 10 degrees, the bevel foot LVr is likely to interfere with the edge opposed surface Rmr when the lens is fitted in the frame. In the example of FIG. 4, the inclination angle αk of the straight line La which is the inclination angle in the vicinity of the point Ps is 15 degrees which is the same as the inclination angle of the conventional processing surface Vrk shown in FIG. 1.

Moreover, the inclination angle in the vicinity of the endpoint Pe is set to an angle or lower where the occurrence of so-called processing interference is suppressed in which the bevel foot LVr processed in the cross-sectional shape of the processing surface Vrk is excessively processed when another processing point of the lens is processed. When the inclination angle in the vicinity of the endpoint Pe is not more than 60 degrees, the occurrence of the processing interference is substantially suppressed. Preferably, the inclination angle in the vicinity of the endpoint Pe is not more than the inclination angle of the processing surface Vr. When the inclination angle is not more than this, the possibility of the occurrence of the processing interference is low as in the bevel formation. In the example of FIG. 4, the path of the processing surface Vrk is an arc with a radius R of 20 mm. When the path is an arc with a radius R of 20 mm and the width (the distance xn in the direction of the line Xp) of the processing surface Vrk is 5 mm, the inclination angle (the increase rate of the distance yn) in the vicinity of the endpoint Pe is approximately 29 degrees.

Figure 5A:
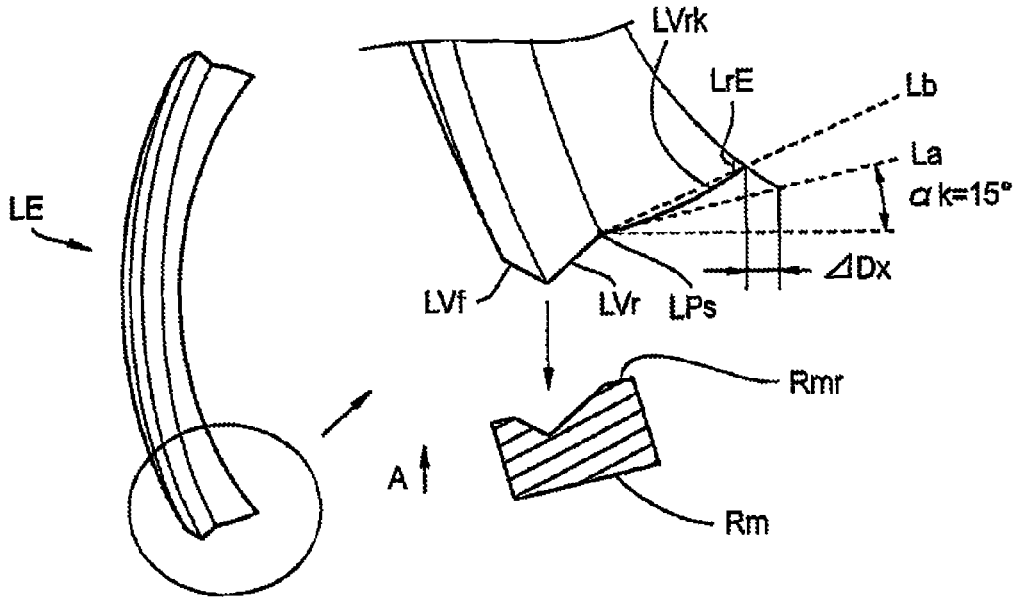
FIGS. 5A and 5B are side views of a high-curve lens processed by the beveling grindstone.
Figure 5B:
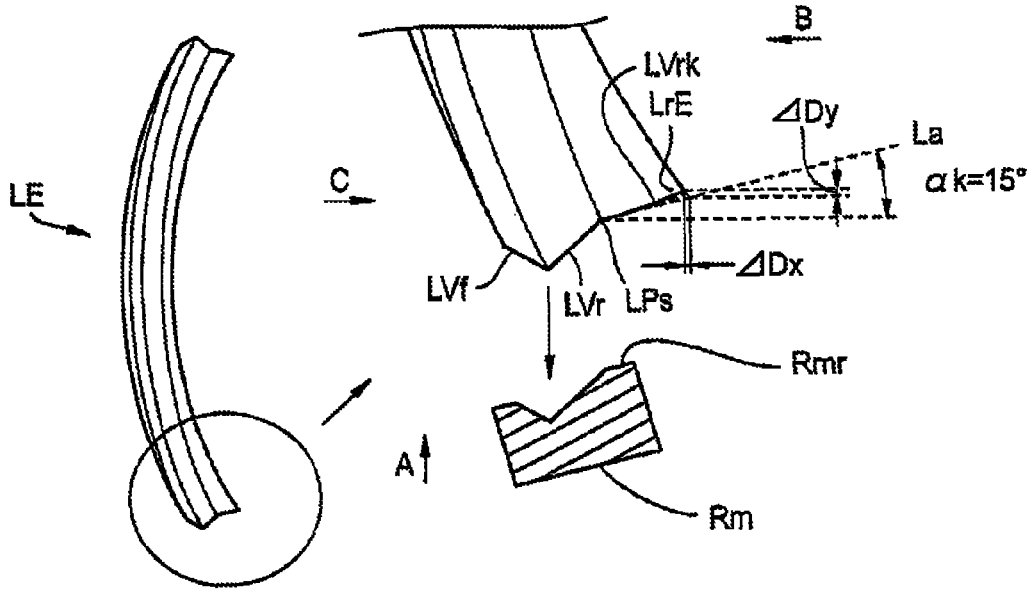

FIGS. 5A and 5B are side views of a high-curve lens processed by the bevel finishing grindstone 163 having the processing surface Vrk shown in FIG. 4. In these figures, a partially enlarged view of an ear-side part is also illustrated. FIG. 5A shows a case where the lens edge is thick, and the rear bevel foot LVrk processed by the processing surface Vrk of FIG. 4 is shown by a solid line. The straight line La of the inclination angle αk (=15 degrees) indicates the processing surface of the conventional beveling grindstone shown in FIG. 1, and the formation condition of the rear bevel foot in this case is indicated by a dotted line. When the rear bevel foot LVrk is viewed from the direction of the arrow A (from the user's ear side), the edge of the rear bevel foot LVrk is thinner by ΔDx than that in the case of the conventional processing along the straight line La, and the thickness of the edge is inconspicuous as when a large chamfer is made. The edge. LrE of the rear bevel foot LVrk is less sharp than that in the case of the processing along the straight line La, so that the edge LrE less frequently touches the user's cheek and this can provide the user with comfort. Even if the shape from the border point LPs between the bevel LVr and the bevel foot LVrk to the end of the edge LrE is constituted by a straight line Lb, the sharpness at the part of the edge LrE is gentle, and this can provide the user with comfort. Further, when the bevel foot LVrk has a curved shape, the sharpness at the part of the edge LrE readily looks gentle.

On the other hand, FIG. 5B shows a case where the lens edge is thin. Compared with the case of the conventional processing at the inclination angle αk of the straight line La, the thickness of the edge when the rear bevel foot LVrk is viewed from the direction of the arrow A is not particularly different and the degree of the sharpness at the part of the edge LrE is not largely different, either. When the lens is thin, the possibility of occurrence of these problems is low. If the inclination angle αk of the straight line La is large like that of the straight line Lb in order to thin the edge by ΔDx equivalent to that in FIG. 5A as a measure for the case where the lens edge is thin, the following problem also arises when the lens edge is thin: The difference ΔDy of the rear bevel foot LVrk when viewed from the lens rear side shown by the arrow B or from the lens front side shown by the arrow C is large, which makes the appearance poor. On the contrary, the processing surface Vrk of FIG. 4 produces the effect of reducing the occurrence of this problem.

Figure 6:
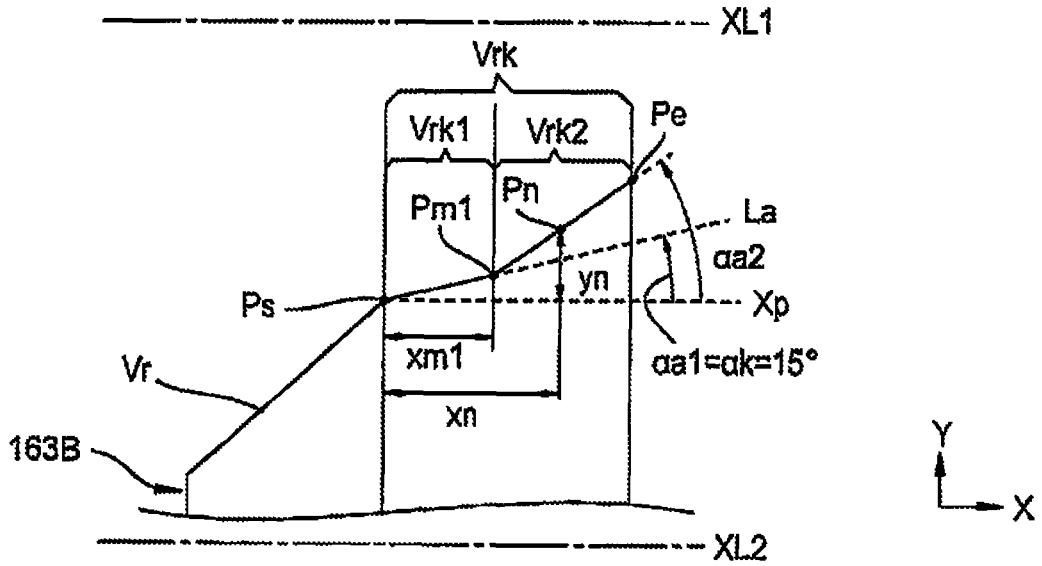
FIG. 6 is an explanatory view of a second example of the processing surface of the rear beveling grindstone.

FIG. 6 is an explanatory view of a second example of the processing surface Vrk. This is an example in which the increase rate of the distance yn from the line Xp increases in two steps toward the endpoint Pe. That is, this is an example in which the inclination angle αn of the processing surface Vrk with respect to the line Xp gradually increases in two steps. Assume that a point that is set between the starting point Ps and the endpoint Pe is Pm1. The inclination angle αa1 (the increase rate of the distance yn) in a first area Vrk1 between the starting point Ps and the point Pm1 is set as a value where the interference between the rear bevel foot LVr and the edge opposed surface Rmr of the rim Rm is avoided when the lens is fitted in the rim Rm of an eyeglass lens (see FIGS. 5A and 5B). For high-curve lenses, the inclination angle αa1 is not less than 10 degrees, preferably, approximately 15 degrees. The inclination angle αa2 of a second area Vrk2 between the point Pm1 and the endpoint Pe is larger than the inclination angle αa1. That is, the processing surface Vrk is formed so that in the first area Vrk1, the distance yn of the point Pn on the path increases at a fixed rate and in the second area Vrk2, the distance yn of the point Pn on the path increases at a fixed rate higher than that in the case of the first area Vrk1. Moreover, in this example, for lenses with an edge thicker than the distance xm1 from the starting point Ps to the point Pm1 in the direction of the line Xp, since the distance yn is large with respect to the straight line La, the edge thickness when viewed from the side can be reduced.

When the inclination angle αn is changed in two steps, it is preferable that the distance xm1 be longer than 1 mm and shorter than 3 mm. In the case of thin-edge lenses where the distance xm1 is at least not more than 1 mm, as in the example of FIG. 5, since the necessity of reducing the edge thickness when viewed from the side is low and the sharpness of the edge of the rear bevel foot is also low, the appearance of the rear bevel foot when viewed from the lens front side or the lens rear side can be enhanced. In the case of lenses with an edge as thick as not less than 3 mm, greater importance is placed on the thinning of the edge when viewed from the side and the suppression of the sharpness of the edge of the rear bevel foot than on the appearance of the rear bevel foot when viewed from the lens front side or the lens rear side.

When the inclination angle of the processing surface Vrk is changed stepwise, the vicinity of the point Pm1 where the inclination angle is changed in the middle is curved. By doing this, the line caused by the change of the inclination angle is inconspicuous on the bevel foot of the processed lens, which enhances the appearance. The increase rate of the distance yn is not limited to two steps but may be more than that.

Figure 7:
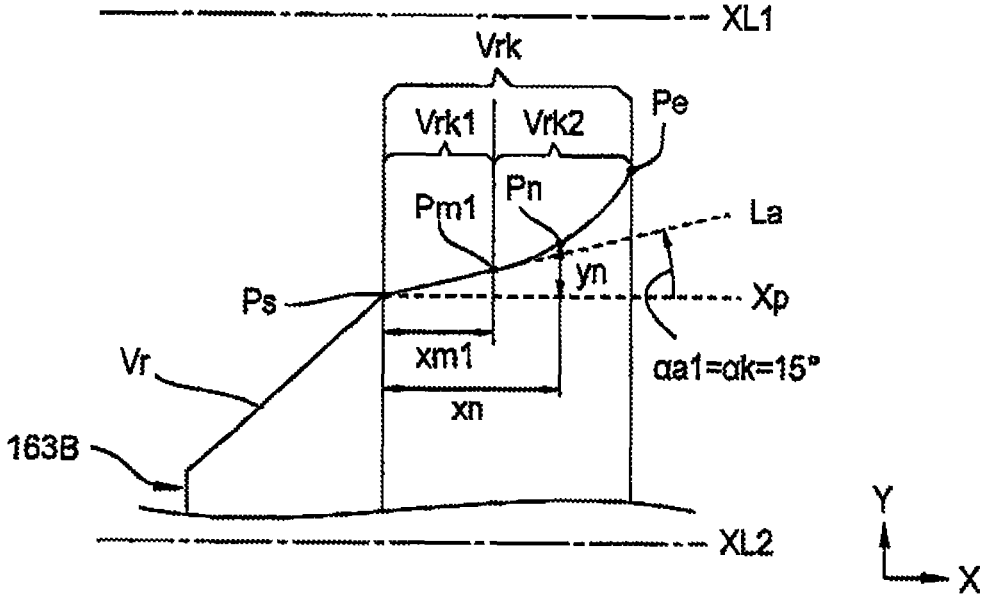
FIG. 7 is an explanatory view of a third example of the processing surface of the rear beveling grindstone.

FIG. 7 is an explanatory view of a third example of the processing surface Vrk. In the third example, in the first area Vrk1 from the starting point Ps to the midpoint Pmt, the processing surface Vrk has a straight line shape where the increase rate of the distance yn (the inclination angle) is constant. In the second area Vrk2 from the point Pm1 to the endpoint Pe, the processing surface Vrk has a curved shape where the increase rate of the distance yn (the inclination angle) continuously gradually increases. The inclination angle αa1 in the first area Vrk1 between the starting point Ps and the point Pm1 is the same as that of the second example of FIG. 6. This area also serves so as to reduce the thickness of the bevel foot viewed from the lens rear side (or the lens front side) in the case of thin-edge lenses. In the example of FIG. 7, the inclination angle αa1 in the first area Vrk1 is the same as the inclination angle αk (=15 degrees) of the straight line La.

The second area Vrk2 in the second and third examples has a shape in which the distance yn is larger than the distance from the straight line La to the line Xp at least in the position where the distance xn is 3 mm. Thereby, in the case of thick lenses where the edge of the rear bevel foot is not less than 3 mm, the edge thickness can be made thinner than the conventional thickness, and the degree of sharpness of the edge end can be reduced.

The increase rate of the distance yn in the second area Vrk2 in the second example and the increase rate of the distance yn in the vicinity of the endpoint Pe in the third example are not more than 60 degrees when expressed as inclination angles, preferably, not more than the increase rate of the distance of the processing surface Vr for rear bevel formation to the line Xp (inclination angle αr=45 degrees). When the increase rate (inclination angle) of the distance yn in the vicinity of the endpoint Pe is too large compared with that of the processing surface Vr, as in the case of bevel formation, the so-called processing interference in which the part processed in the cross-sectional shape of the processing surface Vrk is excessively processed when another processing point is processed is likely to occur. By doing as described above, the occurrence of this problem can be suppressed.

Figure 8:
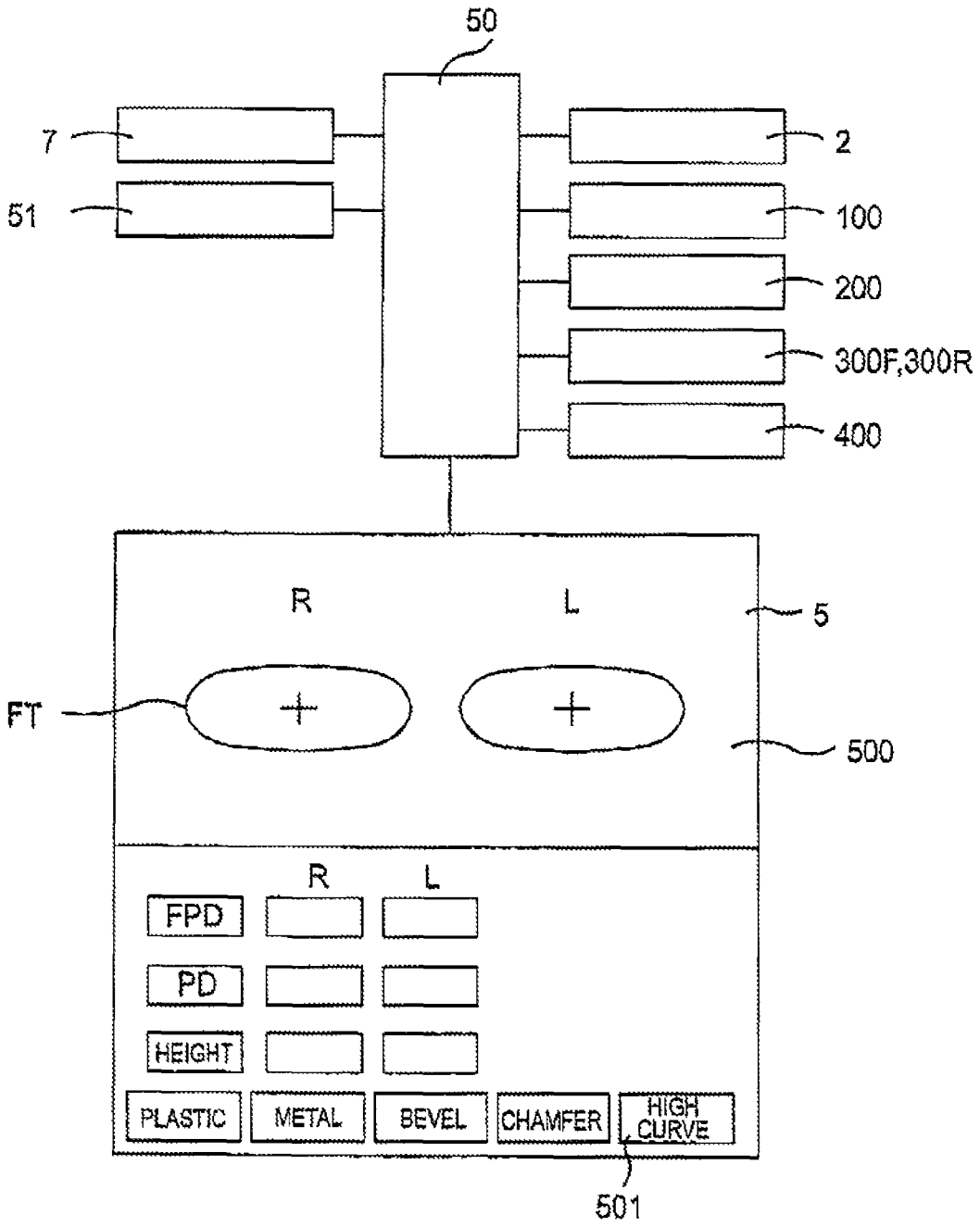
FIG. 8 is a control block diagram of the apparatus.

Next, the operation of the beveling by the present apparatus will be briefly described. FIG. 8 is a control block diagram of the present apparatus. In the lens periphery processing, the target lens shape data (the radius vector length rn, the radius vector angle θn) (n=1, 2, . . . , N) obtained by an eyeglass frame shape measurement unit 2 is input, and layout data such as the distance between the right and left pupils of the user (PD value), the distance between the centers of the right and left rims of an eyeglass frame (FPD value) and the height of the optical center with respect to the geometric center of the target lens shape is input by a key operation on a display 5. Processing conditions such as the lens material, the frame kind and the processing mode (beveling, flat-processing, grooving) are set by a key operation on the display 5. When a bevel is to be formed on a high-curve lens, a high curve mode is selected by a key 501.

When a start signal of a switch unit 7 is input, first, the lens edge position measurement units 300P and 300R are actuated, and the edge positions of the front and rear surfaces of the lens LE held by the lens chuck shafts 102R and 102L are measured based on the target lens shape data. After the edge positions of the lens front and rear surfaces are obtained, the path of the bevel apex located on the lens edge is calculated by a control unit 50. When the high curve mode is set, the bevel apex path is calculated so as to be along the lens front surface curve and be in a position shifted by a predetermined amount (0.3 mm) rearward from the edge position of the lens front surface. After the bevel apex path calculation is completed, a bevel simulation screen (not shown) is displayed on the display 5. On this screen, data for the adjustment of the amount of rearward shift of the bevel apex position from the lens front surface and data for the adjustment of the height of the bevel apex from the border point LPs between the rear bevel and the bevel foot (see FIG. 3) can be input.

Then, when a processing start signal is input, the motor 145 and the motor 150 are driven, and the lens chuck shafts 102L and 102R are moved so that the lens LE is located on the rough grindstone 165. Then, by controlling the positions, in the y-axis direction, of the lens chuck shafts 102L and 102R according to the rough-edging data obtained based on the target lens shape data, the periphery of the lens LE is roughed.

After roughing is finished, the process shifts to beveling. When the high curve mode is set, the bevel finishing grindstone 163 for high-curve lenses is used, and the front bevel and the rear bevel are processed by the front beveling grindstone 168A and the rear beveling grindstone 163B, respectively. First, the front bevel is processed. Every predetermined rotation angle of the lens, the control unit 50 obtains processing data which is data on the movements in the x-axis direction and the y-axis direction when the bevel apex is in contact with the position of a predetermined diameter of the processing surface Vf of the front beveling grindstone 163A. The x-axis motor 145 and the y-axis motor 150 are controlled according to this processing data. Thereby, the front bevel LVf is formed. Then, the control unit 50 obtains the path of the border point LPs of the lens LE based on the data for the adjustment of the height of the bevel apex, and every predetermined rotation angle of the lens, obtains processing data which is data on the movements in the x-axis direction and the y-axis direction when the border point LPs is located at the border point Ps of the rear beveling grindstone 163B. By controlling the x-axis motor 145 and the y-axis motor 150 according to this processing data, the rear bevel is processed by the processing surface Vr of the rear beveling grindstone 163B, and the rear bevel foot is processed by the processing surface Vrk at the same time.

As shown in FIGS. 5A and 5B, the rear bevel foot LVrk of the lens is processed according to the edge thickness by the shape of the processing surface Vrk. When the edge is thick, as shown in FIG. 5A, the edge is processed so as to be thinner by ΔDx than the conventional thickness in a condition close to when a large chamfer is made. For this reason, it is unnecessary to perform chamfering after beveling, so that the time for chamfering using the chamfering mechanism 200 is reduced. Moreover, in the case of high-curve lenses, even if the chamfering mechanism 200 is used, it is difficult to secure a desired amount of chamfer since it is difficult to accurately obtain the edge end position of after beveling. However, since the shape of the processing surface Vrk is designed also for chamfering, the appearance of the edge can be enhanced.

In the chamfering by the chamfering mechanism 200, it is necessary for the operator to determine whether to perform chamfering or not, and it is also necessary for the operator to determine the amount of chamfer. To do this, the operator is required to have knowledge and experiment. When the degree of refractive power (edge thickness) is different between the lens for the right eye and the lens for the left eye, the determination of whether to perform chamfering or not and the amount of chamfer that results in good appearance is further difficult. On the contrary, when the shape of the processing surface Vrk is as described above, neither the setting of chamfering nor a difficult determination is required of the operator, so that the chamfering process is simplified and the edge can be processed so as to be thin and look nice according to the edge thickness.

The shapes of the processing surface Vrk as shown in FIGS. 4, 6 and 7 are not limited to the bevel finishing grindstone 163 for high-curve lenses, but may be applied to the bevel finishing grindstone 164 for low-curve lenses. In this case, the processing surface Vrk for rear bevel foot formation is formed with the inclination angle αk of the straight line La being substantially zero (or a slight angle such as 2.5 degrees).

The beveling tool is not limited to the grindstone, but a tool such as a cutter or an end mill having the processing parts shown in FIG. 4, etc. is applicable.

Figure 9:
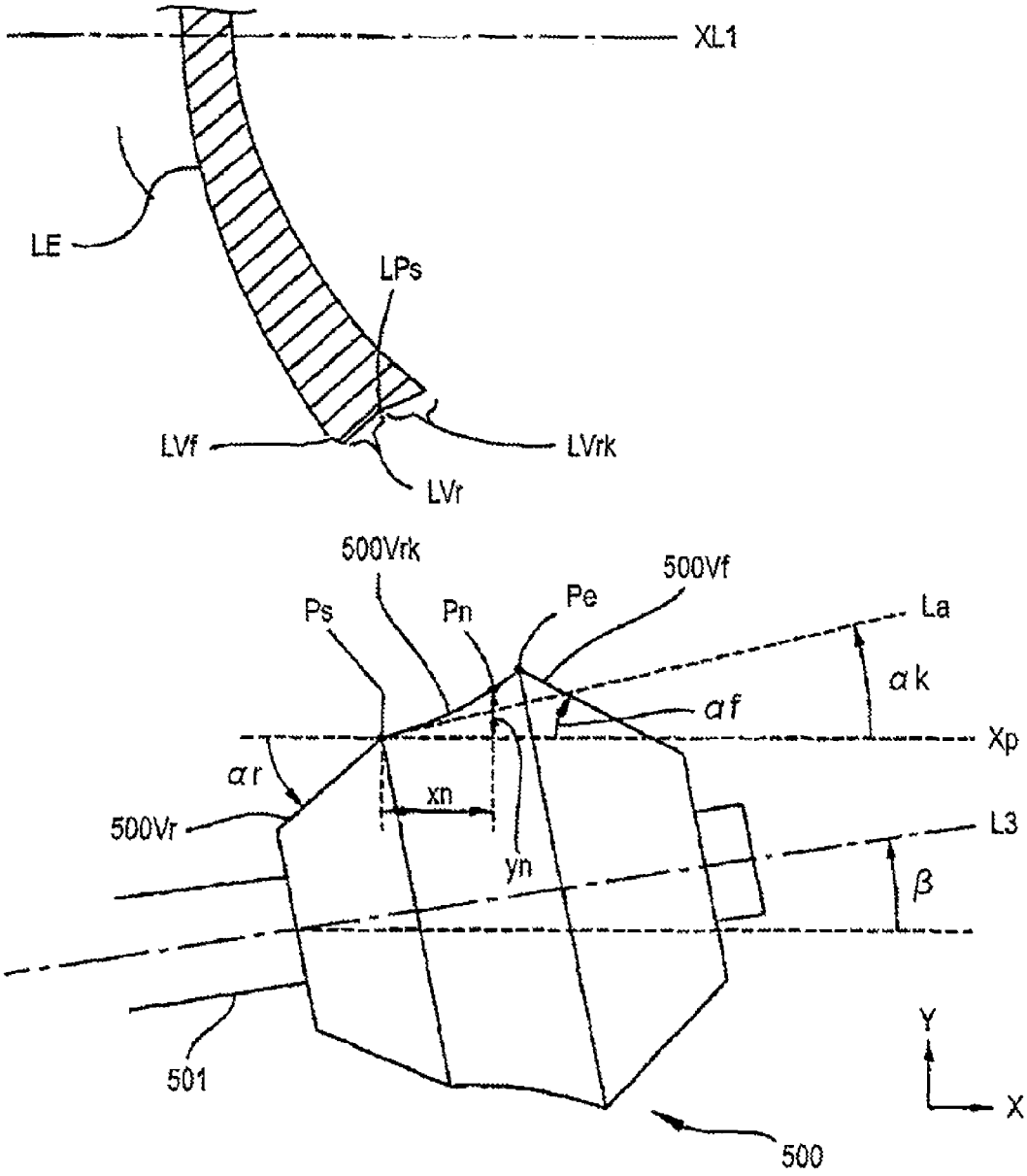
FIG. 9 shows an example in which a small-diameter grindstone is used as a beveling tool.

FIG. 9 shows an example in which a small-diameter grindstone is used as the beveling tool for high-curve lenses and the small-diameter beveling grindstone is attached to a spindle different from the spindle (grindstone rotation axis) 161*a* to which the bevel finishing grindstone 164, the rough grindstone 165 and the like are attached.

In FIG. 9, a beveling grindstone 500 is provided with a first processing surface 500Vr for rear bevel formation, a second processing surface 500Vrk for rear bevel foot formation and a third processing surface 500Vf for front bevel formation. In this example, the first processing surface 500Vr and the third processing surface 500Vf for front bevel formation are separated from each other, and are disposed on opposite ends of the grindstone 500. The grindstone 500 is attached to a spindle 501 different from the spindle (grindstone rotation axis) 161*a*: As the spindle 501 and the rotation mechanism, one same as the mechanism 200 shown in FIG. 2 is used. The spindle 501 is rotated by a motor (not shown) of the mechanism 200. In this case, the axis line L3 of the spindle 501 is not parallel to the axis line XL1 of the lens chuck shafts 102R and 102L but is inclined an angle δ as in the case where the chamfering grindstone of the mechanism 200 is disposed. The angle θ is, for example, approximately 10 degrees.

In FIG. 9, Xp represents a line parallel to the axis line XL1 of the lens chuck shafts and passing through the border point Ps between the processing surface 500Vr and the processing surface 500Vrk. While the axis line L3 of the spindle 501 is inclined the angle β with respect to the line Xp (x direction), the inclination angle αr of the processing surface 500Vr and the inclination angle αf of the processing surface 500Vf with respect to the line Xp are set to 45 degrees and 30 degrees, respectively, as in the case of FIG. 4. The processing surface 500Vrk for rear bevel foot formation has a shape in which the inclination angle with respect to the direction of the line Xp gradually increases at least in two steps from the starting point Ps to the endpoint Pe as in FIGS. 4, 6 and 7. That is, the processing surface 500Vrk has a shape in which the increase rate of the distance yn from the point Pn to the line Xp gradually increases at least in two steps from the starting point Ps to the endpoint Pe. The example of FIG. 9 has a curved shape in which the inclination angle (the increase rate of the distance yn) of the processing surface Vrk continuously gradually increases from the starting point Ps toward the endpoint Pe like the first example of FIG. 4.

In the process of manufacturing the beveling grindstone 500, the offset corresponding to the inclination angle β of the axis line L3 of the grindstone rotation axis is calculated in forming the processing surface 500Vrk.

What is claimed is:

1. An eyeglass lens processing apparatus comprising:

a lens rotating unit which includes a lens chuck shaft for holding an eyeglass lens and a motor for rotating the lens chuck shaft; and a tool rotating unit which includes a beveling tool for forming a bevel on a periphery of the lens, a spindle to which the beveling tool is attached and which is disposed parallel to the lens chuck shaft or disposed to be inclined with respect to the lens chuck shaft at a predetermined angle, and a motor for rotating the spindle, wherein the beveling tool includes a first processing part for forming a rear bevel at a rear side of the lens and a second processing part for forming a bevel foot coupled to the rear bevel, and wherein in the second processing part, a distance from a line parallel to the lens chuck shaft and passing through a point of a border with the first processing part gradually increases from the border point as the starting point to an endpoint of the second processing surface and an increase rate of the distance gradually increases at least in two steps from the border point to the endpoint.

2. The eyeglass lens processing apparatus according to claim 1, wherein in a case in which the increase rate of the distance is expressed by an inclination angle with respect to the line parallel to the lens chuck shaft, the inclination angle in the vicinity of the border point is not less than 10 degrees and the inclination angle in the vicinity of the endpoint is not more than 60 degrees.

3. The eyeglass lens processing apparatus according to claim 1, wherein the second processing part at least partially includes a curved shape in which the increase rate of the distance continuously gradually increases toward the endpoint.

4. The eyeglass lens processing apparatus according to claim 1, wherein the second processing part includes a curved shape in which the increase rate of the distance continuously gradually increases from the border point to the end point.

5. The eyeglass lens processing apparatus according to claim 1, wherein the second processing part includes a straight line shape where the increase rate of the distance is constant from the border point to the midpoint located between the border point and the end point, and a curved shape where the increase rate of the distance continuously gradually increases from the midpoint to the end point.

* * * * *